US009359698B2

(12) United States Patent
Shimazaki

(10) Patent No.: US 9,359,698 B2
(45) Date of Patent: Jun. 7, 2016

(54) SHEDDING APPARATUS FOR WASTE SELVAGE IN A LOOM

(71) Applicant: KABUSHIKI KAISHA TOYOTA JIDOSHOKKI, Kariya-shi, Aichi-ken (JP)

(72) Inventor: Haruo Shimazaki, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 0 days.

(21) Appl. No.: 14/465,261

(22) Filed: Aug. 21, 2014

(65) Prior Publication Data

US 2015/0059914 A1 Mar. 5, 2015

(30) Foreign Application Priority Data

Aug. 27, 2013 (JP) ..... 2013-175701

(51) Int. Cl.

| | |
|---|---|
| ***D03C 7/08*** | (2006.01) |
| ***D03C 7/04*** | (2006.01) |
| ***D03C 7/00*** | (2006.01) |
| ***D03C 11/00*** | (2006.01) |
| *D03C 13/00* | (2006.01) |

(52) U.S. Cl.

CPC *D03C 11/00* (2013.01); *D03C 7/00* (2013.01); *D03C 13/00* (2013.01)

(58) Field of Classification Search

CPC ..... D03C 7/08; F16H 1/46; F16H 1/28; F16D 2027/007; F16D 27/12; D03D 51/00; D03D 51/06

See application file for complete search history.

(56) References Cited

U.S. PATENT DOCUMENTS

| | | | | |
|---|---|---|---|---|
| 3,181,568 | A * | 5/1965 | Dewas | 139/430 |
| 4,103,714 | A * | 8/1978 | Hasebe | 139/1 C |
| 4,166,480 | A * | 9/1979 | Muller | 139/54 |
| 5,392,819 | A * | 2/1995 | Lin | 139/430 |
| 6,532,996 | B2 * | 3/2003 | Tamura | 139/1 E |
| 8,137,230 | B2 * | 3/2012 | Omura et al. | 475/149 |
| 2002/0153051 | A1 * | 10/2002 | Tamura | 139/100 |
| 2009/0321214 | A1 * | 12/2009 | Hoshino et al. | 192/84.961 |

FOREIGN PATENT DOCUMENTS

| | | |
|---|---|---|
| GB | 1010467 | 11/1965 |
| GB | 1065900 | 4/1967 |
| JP | 52-91956 | 8/1977 |
| JP | 60-189579 U | 12/1985 |
| JP | 63-106782 U | 7/1988 |
| JP | 1-174633 A | 7/1989 |
| JP | 2010-100974 A | 5/2010 |
| JP | 2010-156061 A | 7/2010 |
| WO | 2004/083506 A2 | 9/2004 |

* cited by examiner

*Primary Examiner* — Bobby Muromoto, Jr.
(74) *Attorney, Agent, or Firm* — Sughrue Mion, PLLC

(57) ABSTRACT

A shedding apparatus for waste selvage includes a pair of first swing levers and a pair of second swing levers for forming an open shed of selvage yarns. The drive force to the swing levers is transmitted by cranking through a drive shaft which is coaxial with the sun gear of a planetary gear mechanism. The crank mechanism using the cranking includes a crank, first end of which is fixedly connected to the drive shaft for rotation therewith, a drive lever for transmitting a rotational force to the swing levers, and a connecting rod connected between second end of the crank and the drive lever. A ratio between an eccentric distance of the crank and a length of the drive lever is less than 1.

4 Claims, 10 Drawing Sheets

Background Art

Background Art

SHEDDING APPARATUS FOR WASTE SELVAGE IN A LOOM

BACKGROUND OF THE INVENTION

The present invention relates to a shedding apparatus for waste selvage in a loom. More specifically, the invention relates to a shedding apparatus for waste selvage in a loom which has a leno selvage forming apparatus drawing selvage yarns from bobbins and forming a leno selvage.

In some fluid jet type looms having a leno selvage forming apparatus for forming a leno selvage, leno selvages are formed in a woven fabric on the weft insertion side of the loom and the other side opposite to the weft insertion side and further waste selvages are formed at positions outward of the respective leno selvages. Generally, in a leno selvage forming apparatus, a planetary gear mechanism including a sun gear and planetary gears is used to cause a pair of yarn guides to revolve so as to draw leno selvage yarns from the respective guides.

Japanese Unexamined Patent Application Publication No. 2010-100974 discloses a shedding apparatus for catch cord in a loom (shedding apparatus for waste selvage) having a leno selvage forming apparatus in which a planetary gear mechanism is used, as a related art such as shown in FIGS. 9 and 10. As shown in FIGS. 9 and 10, a shedding apparatus for catch cord 100 is provided adjacent to a planetary selvage apparatus 200 (leno selvage forming apparatus) which is provided on the side opposite to the weft insertion side of the loom.

In the shedding apparatus for catch cord 100, a beam 204 is provided between opposite side frames (not shown) of the loom and a rail 205 is fixed on an upper surface of the beam 204. A frame 203 of the planetary selvage apparatus 200 is mounted on the upper surface of the rail 205. Specifically, the frame 203 of the planetary selvage apparatus 200 is detachably fixed on the rail 205 with a bolt (not shown) so that the position of the planetary selvage apparatus 200 along the rail 205 can be changed according to a change of the weaving width of a fabric to be woven. A drive shaft 206 extends parallel to the rail 205 on the side thereof that is closer to a let-off side of the loom. The drive shaft 206 is connected to a motor of the loom through a transmission apparatus so that the drive shaft 206 is rotated in conjunction with the spindle of the loom.

In the planetary selvage apparatus 200, a support 210 for supporting planetary gears 208 and the like is fixed on a rotating shaft 214 which is rotatably supported by the frame 203. The support 210 is rotated by the drive shaft 206 through a drive timing pulley 209, a driven timing pulley 215, and a timing belt 216. A pair of intermediate gears 218 is engaged with a sun gear 217 at positions angularly spaced from each other at 180 degrees. The number of the teeth of the respective planetary gears 208 is half that of the sun gear 217. Each planetary gear 208 is engaged with its corresponding intermediate gear 218.

In the shedding apparatus for catch cord 100, a first shaft 101 and a second shaft 102 are supported by the frame 203 of the planetary selvage apparatus 200. The first shaft 101 supports first swing levers 111, 112 via a first swing lever holder 132, and the second shaft 102 supports second swing levers 113, 114 via a second swing lever holder 133. An eccentric bush 127 whose inner circumferential surface and outer circumferential surface have different axial centers is fitted on the drive shaft 206 at a position that is closer to a warp row than to the drive timing pulley 209. The eccentric bush 127 is fixed to the drive shaft 206 so that the position of the eccentric bush 127 in the axial direction thereof and the position of the eccentric bush 127 in the circumferential direction thereof, i.e., the phase of the eccentric bush 127 may be changed with respect to the drive shaft 206.

A swing arm 130 is rotatably supported at first end thereof on the eccentric bush 127, and second end of the swing arm 130 and the first swing lever holder 132 are connected to each other via a link pin 134. The first swing lever holder 132 and the second swing lever holder 133 are swingably supported by the first shaft 101 and the second shaft 102, respectively. The first swing lever holder 132 and the second swing lever holder 133 are connected to each other via a connecting link 139.

When the drive shaft 206 is rotated, the first swing lever holder 132 is swung through the eccentric bush 127 and the swing arm 130, thereby causing the second swing lever holder 133 to swing in the reverse direction through the connecting link 139.

In Japanese Unexamined Utility Model Application Publication No. 63-106782 discloses a shedding apparatus for waste selvage employing a passive drive system which uses a spring or a cam.

Unlike the shedding apparatus for waste selvage disclosed in the above Japanese Unexamined Utility Model Application Publication No. 63-106782, the shedding apparatus for waste selvage disclosed in Japanese Unexamined Patent Application Publication No. 2010-100974 employs a positive drive system which does not require a spring or a cam. The shedding apparatus for waste selvage disclosed in Japanese Unexamined Utility Model Application Publication No. 63-106782 that employs a passive drive system, the cam attached to the leno selvage forming apparatus generates a large moment of inertia, resulting in a large increase of the load. The load caused by the spring in the passive drive system is also larger than the load developed in the case of the positive drive system. Therefore, the positive drive system is advantageous over the passive drive system.

In the shedding apparatus for wastes selvage disclosed in Japanese Unexamined Patent Application Publication No. 2010-100974, however, the eccentric bush 127 that serves as the drive source for the shedding apparatus for waste selvage (the shedding apparatus for catch cord 100) and the drive timing pulley 209 that transmits drive force to the leno selvage forming apparatus are mounted on the drive shaft 206 that is provided separately from the shaft of the sun gear 217 of the leno selvage forming apparatus (the planetary selvage apparatus 200). Therefore, when changing the weaving width of the loom, fasteners for the drive timing pulley 209 and the eccentric bush 127 need to be loosened to allow the drive timing pulley 209 and the eccentric bush 127 to be relocated and then be re-tightened after the relocation is over. Furthermore, the timings need to be set again for each apparatus. Thus, the work associated with changing of the weaving width is troublesome and time consuming.

The present invention, which has been made in view of the circumstances above, is directed to providing a shedding apparatus for waste selvage in a loom which reduces the load applied to the drive for the shedding apparatus for waste selvage and requires less time for the work associated with changing the weaving width of the loom.

SUMMARY OF THE INVENTION

In order to solve the above-identified problems, in accordance with an aspect of the present invention, provided is a shedding apparatus for waste selvage in a loom having a leno selvage forming apparatus of a planetary gear type having a sun gear and a pair of planetary gears which revolves around the sun gear. The shedding apparatus for waste selvage includes a pair of swing levers for forming an open shed of selvage yarns, and drive force to the swing levers is transmitted by a crank mechanism through center axis of a rotating support supporting the planetary gears.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the embodiment together with the accompanying drawings in which:

DETAILED DESCRIPTION OF THE PREFERRED EMBODIMENTS

The following will describe the embodiment of a shedding apparatus for waste selvage in a loom having a leno selvage forming apparatus using an electric motor that is independent from a motor for driving the loom with reference to FIGS. 1 to 8.

Figure 1:
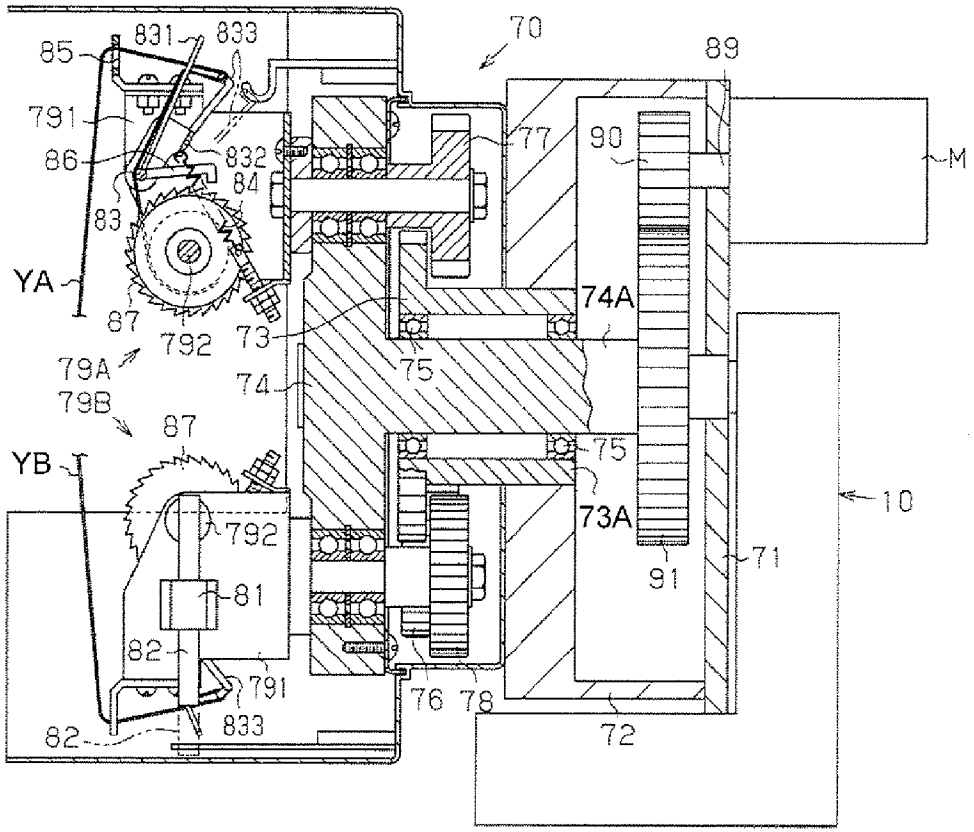
FIG. 1 is a partially cutaway plan view schematically showing a relationship between a leno selvage forming apparatus and a shedding apparatus for waste selvage.

Referring to FIG. 1, the shedding apparatus for waste selvage is designated by 10 and will be referred to merely as the shedding apparatus 10. The shedding apparatus 10 is disposed adjacent to the leno selvage forming apparatus that is designated by 70 and provided on the side of the loom opposite to the weft insertion side. The leno selvage forming apparatus 70 has a bracket 71 fixed to a stand which is detachably fixed so that its mounting position is adjustable along a rail provided on a reinforcement bar extending between the right and left side frames of the loom. With the rail unfastened from the stand, the position of the leno selvage forming apparatus 70 and the shedding apparatus 10 along the rail can be changed.

The leno selvage forming apparatus 70 has substantially the same configuration as that disclosed in Japanese Unexamined Patent Application Publication No. 2004-250816. The leno selvage forming apparatus 70 has a cylindrical base frame 72 which is fixed to the bracket 71 and a sun gear 73 is fixed to the base frame 72. A drive shaft 74A that is unitary and coaxial with a rotating support 74 is rotatably supported on a hollow shaft 73A of the sun gear 73 through bearings 75. In other words, the drive shaft 74A and the sun gear 73 are coaxial.

A pair of intermediate gears 76 is rotatably supported at positions on the rear side of the rotating support 74 that are angularly spaced from each other at 180 degrees. A pair of planetary gears 77, 78 is also rotatably supported at positions on the rear side of the rotating support 74 that are angularly spaced apart from each other at 180 degrees. The intermediate gears 76 are engaged with the sun gear 73 and the planetary gears 77, 78.

A pair of bobbin holders 79A, 79B is disposed on the front side of the rotating support 74. The bobbin holders 79A, 79B are connected to the respective planetary gears 77, 78 for rotation therewith.

Each of the bobbin holders 79A, 79B has a retaining frame 791 which removably retains a support pin 792. A bobbin (not shown) is rotatably supported on each of the support pins 792. A slide guide 81 is fixed to each retaining frame 791 on one side thereof and a spring stopper 82 is mounted to the slide guide 81. The slide guide 81 and the stopper 82 cooperate to form a mechanism for preventing the support pin 792 from coming off from the retaining frame 791.

A guide 831 is fixed on the shaft 83 and a tension plate 832 is rotatably supported on the shaft 83. The tension plate 832 has a tension arm 833 projecting therefrom. A tension spring 84 is mounted between the retaining frame 791 and its associated tension plate 832. Selvage yarns YA, YB unwound from the bobbins are drawn in sliding contact with the shaft 83, the guide 831 and the tension arms 833 to be led out through guide holes 85. The tension springs 84 impart a tension via the tension arms 833 to the selvage yarns YA, YB being led out from the guide holes 85.

A ratchet pawl 86 is rotatably mounted on each of the shafts 83. The pawl 86 is urged by the tension spring 84 to be engaged with a ratchet wheel 87 mounted in the bobbin. When the tension of the selvage yarns YA, YB is increased to a predetermined level, the shaft 83 is rotated against the urging force of the tension springs 84 and the pawl 86 is disengaged from the ratchet wheels 87 thereby to allow the bobbin to rotate. As a result, the selvage yarns YA, YB are unwound from the bobbins to form a leno by the rotation of the rotating support 74.

An electric motor M is mounted on the bracket 71 to drive the shedding apparatus 10 and the leno selvage forming apparatus 70. The electric motor M has an output shaft 89 on which the drive gear 90 is fixed. The rotating support 74 has a drive shaft 74A on which a driven gear 91 is fixed. The drive gear 90 engages with the driven gear 91 within the cylindrical base frame 72, so that the rotating support 74 is driven to rotate by the electric motor M through the drive gear 90 and the driven gear 91. During weaving operation of the loom, the rotating support 74 makes a half rotation for one complete rotation of the loom, causing the planetary gears 77, 78 to make a half revolution around the sun gear 73 while rotating on their own axes against the sun gear 73 in a direction opposite to the rotating direction of the rotating support 74. Accordingly, the selvage yarns YA, YB of the bobbins in the bobbin holders 79A, 79B are drawn out through the guide holes 85 and leno-woven. Thus, the shedding apparatus 10 has a leno selvage forming apparatus 70 including the sun gear 73 and the planetary gears 77, 78 that revolve around the sun gear 73.

Figure 2:
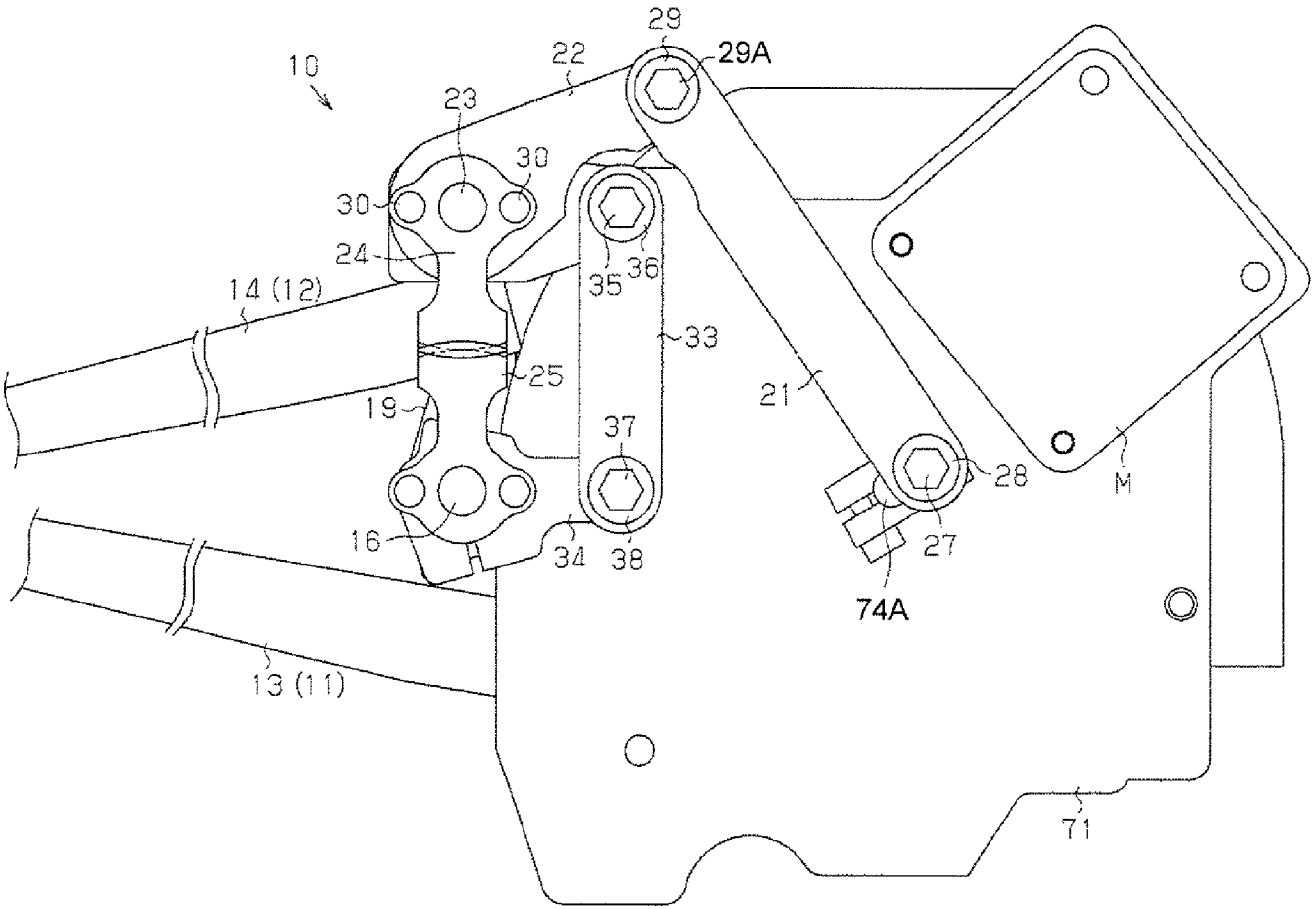
FIG. 2 is a schematic side view of the shedding apparatus for waste selvage of FIG. 1.
Figure 3:
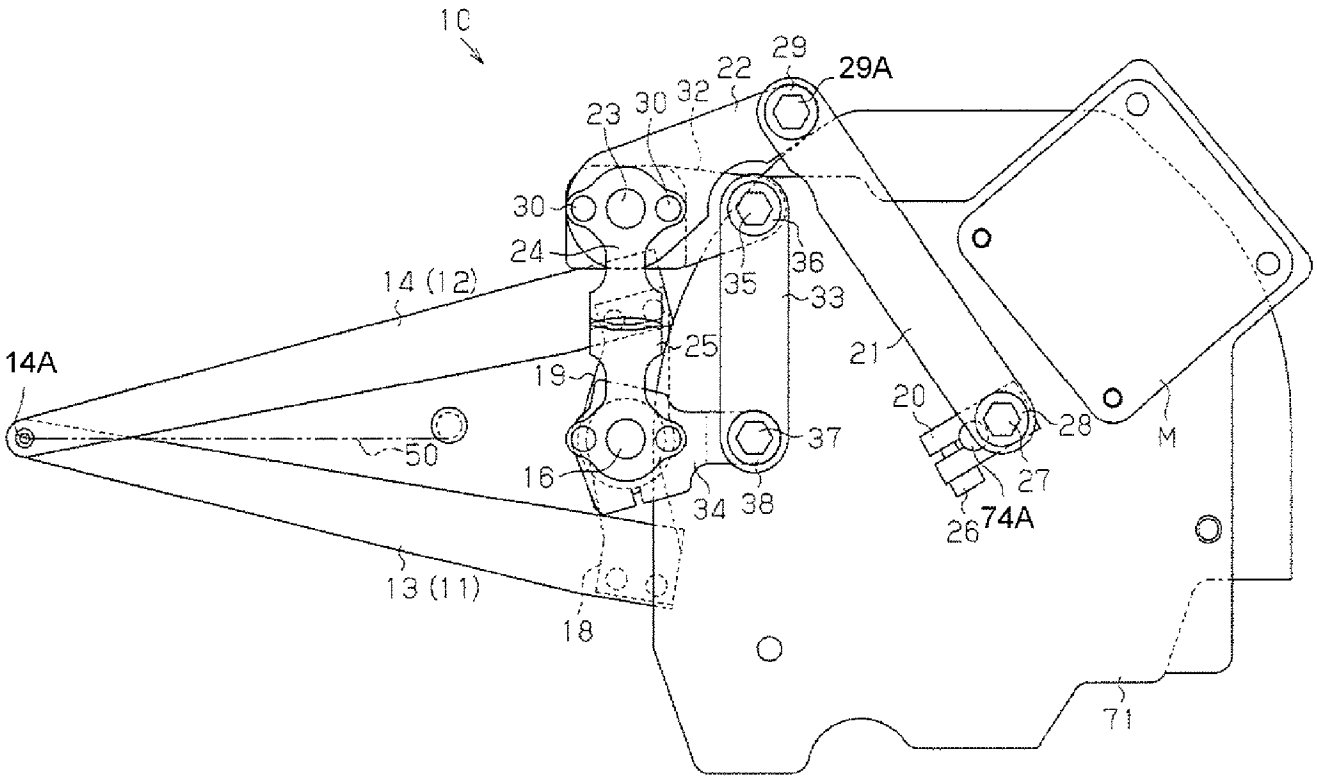
FIG. 3 is a side view of the shedding apparatus for waste selvage.
Figure 4:
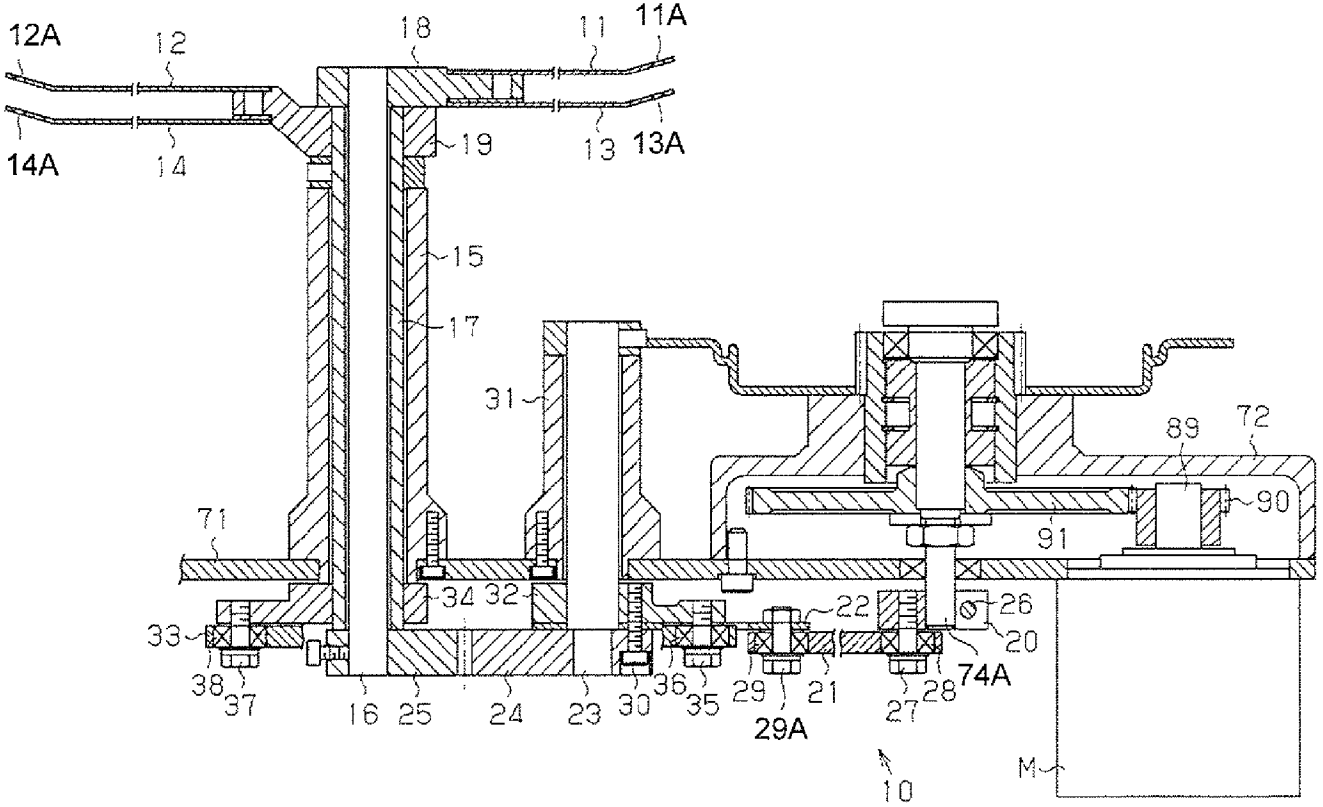
FIG. 4 is a partial cross-sectional view of the shedding apparatus for waste selvage in an unfolded state, illustrating support relationship of components such as levers.

Referring to FIGS. 2, 3 and 4, the shedding apparatus 10 includes a pair of first swing levers 11, 13 and a pair of second swing levers 12, 14 for forming a shed between selvage yarns (warp yarns for waste selvage). The first swing levers 11, 13 and the second swing levers 12, 14 are driven to swing by the drive shaft 74A of the rotating support 74 through a crank mechanism. Specifically, the drive shaft 74A of the rotating support 74 is passed through the bracket 71 so as to extend out from the side of the bracket 71 opposite to the leno selvage forming apparatus 70 and the drive force of the drive shaft 74A is transmitted by cranking to the first swing levers 11, 13 and the second swing levers 12, 14. The first swing levers 11, 13 and the second swing levers 12, 14 are of substantially the same length and have in the ends thereof eyelets 11A, 12A, 13A, 14A through which selvage yarns are passed. The second swing lever 12 is arranged so as to be able to pass between the first swing levers 11, 13, and the first swing lever 13 is arranged so as to be able to pass between the second swing levers 12, 14.

Referring to FIG. 4, a first rotating shaft 16 and a second rotating shaft 17 extend through a cylindrical support 15 fixed to the bracket 71 and are supported concentrically so as to be rotatable relative to each other. The first rotating shaft 16 is formed of a solid cylindrical member and the second rotating shaft 17 is formed of a hollow cylindrical member fitted loosely and hence rotatably on the first rotating shaft 16. A support member 18 is fixedly mounted on the first rotating shaft 16 for rotation therewith and the first swing levers 11, 13 are fixed at the proximal ends thereof parallel to each other to the support member 18. A support member 19 is fixedly mounted on the second rotating shaft 17 that is provided concentric to the first rotating shaft 16, and the second swing levers 12, 14 are fixed at the proximal ends thereof to the support member 19 parallel to each other. The second rotating shaft 17 is fixed to the bracket 71 by being inserted through the cylindrical support 15 that is fixed on the bracket 71.

The drive force to the first swing levers 11, 14, that is, the drive force to the first rotating shaft 16 is transmitted from the drive shaft 74A through a crank 20, a connecting rod 21, a drive lever 22, a first sector gear 24, and a second sector gear 25.

Figure 7:
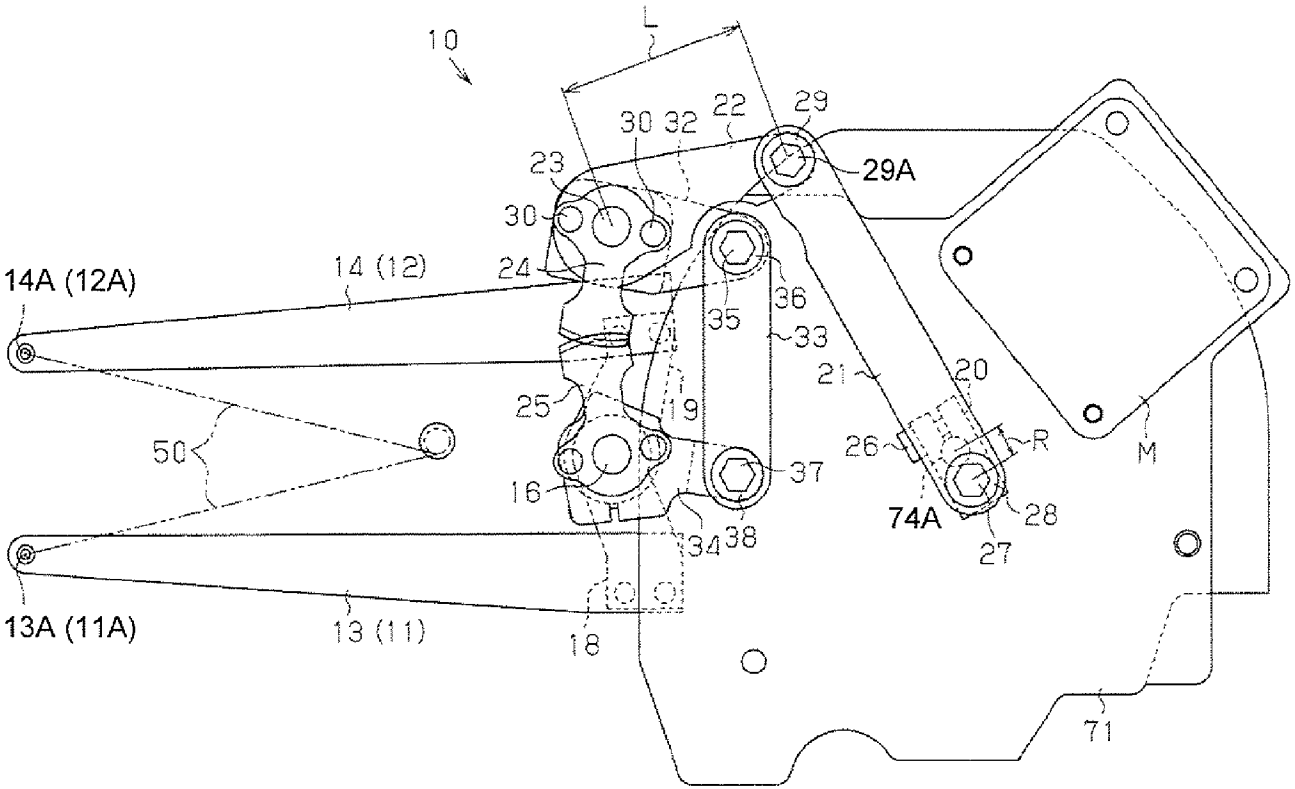
FIG. 7 is a side view of the shedding apparatus for waste selvage wherein the drive shaft is rotated counterclockwise by 90 degrees from the position of FIG. 6.

Specifically, the crank 20 is fastened at first end thereof to the drive shaft 74A with a bolt 26. The first end of the crank 20 is provided with a slit which allows the fixation of the crank 20 to the drive shaft 74A at any desired position in the radial direction thereof. The connecting rod 21 is connected between second end of the crank 20 and the drive lever 22. The first end of the connecting rod 21 is screwed to the crank 20 and rotatably connected to a bolt 27, which also serves as a shaft, through a bearing 28. The second end of the connecting rod 21 is rotatably connected to the first end of the drive lever 22 through a bearing 29 and a bolt 29A, which also serves as a shaft. As shown in FIG. 7, the ratio of eccentric distance R of the crank 20 to the length L of the drive lever 22, or the ratio R/L, should preferably be less than 1 and more preferably one third or less. The eccentric distance R of the crank 20 refers to a distance between the axial center of the drive shaft 74A and the rotational center of the connecting rod 21 that is connected to the crank 20 connected to the connecting rod 21. The length L refers to the distance between the rotational center in one end of the drive lever 22 connected to the connecting rod 21 and the rotational center in the other end of the drive lever 22.

As shown in FIGS. 3 and 4, second end of the drive lever 22 is fixedly connected to the first sector gear 24 as a rotating lever with a bolt 30. A first sector gear 24 is rotatably supported by an end of a support shaft 23 which is inserted through a cylindrical support 31 fixed to the bracket. The support shaft 23 also serves as the rotational center of the second end of the drive lever 22. The second sector gear 25, which is in engagement with the first sector gear 24, is fixed integrally rotatably on the first rotating shaft 16 at the proximal end thereof.

The drive force to the rotating shaft 17 and hence for the second swing levers 12, 14 is transmitted from the drive shaft 74A through the crank 20, the connecting rod 21, the drive lever 22, a rotating lever 32, a link 33, and a connecting lever 34.

Specifically, the second end of the drive lever 22 is fixedly connected to the first sector gear 24 and the rotating lever 32 with the bolt 30. The rotating lever 32 is rotatably connected to first end of the link 33 by a bolt 35 and a bearing 36. Second end of the link 33 is rotatably connected through a bearing 38 to the connecting lever 34 with a bolt 37. The connecting lever 34 is fastened to the second rotating shaft 17 with a bolt (not shown) for rotation with the second rotating shaft 17.

The following will describe the operation of the above-described shedding apparatus 10.

Figure 8:
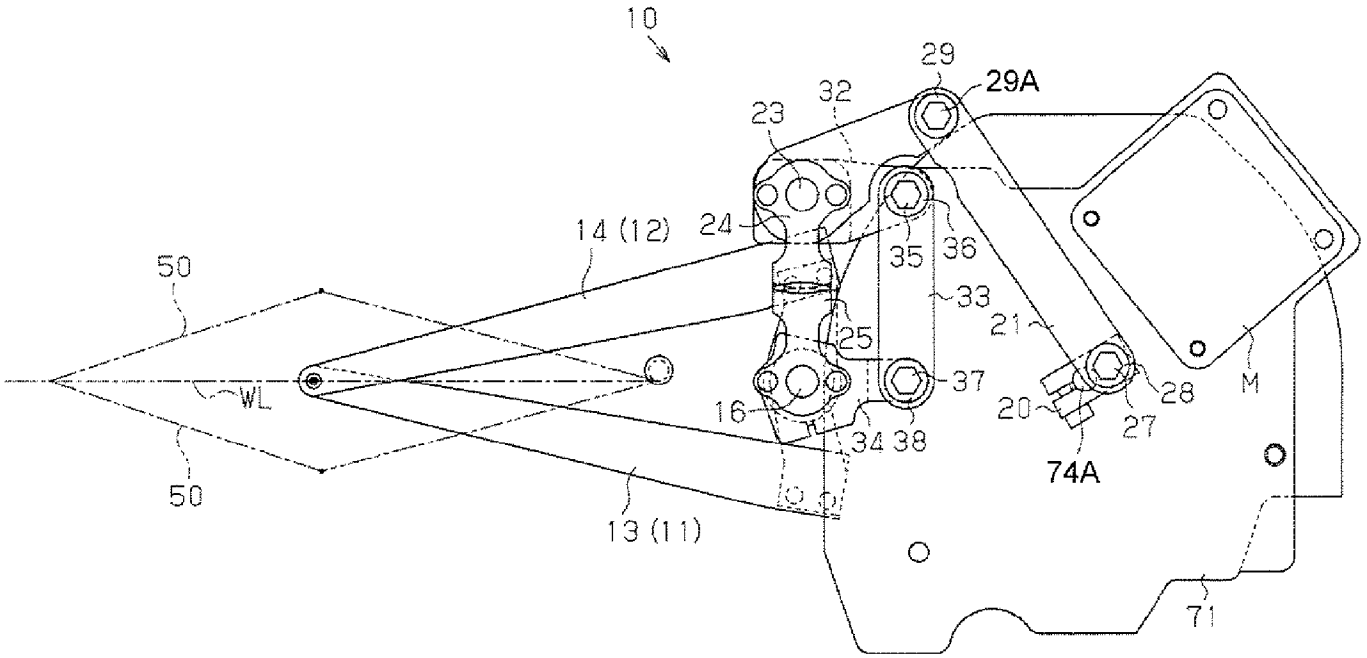
FIG. 8 is a side view of the shedding apparatus for waste selvage, showing a state in which an open shed is formed by selvage yarns and the then position of the swing levers.
Figure 9:
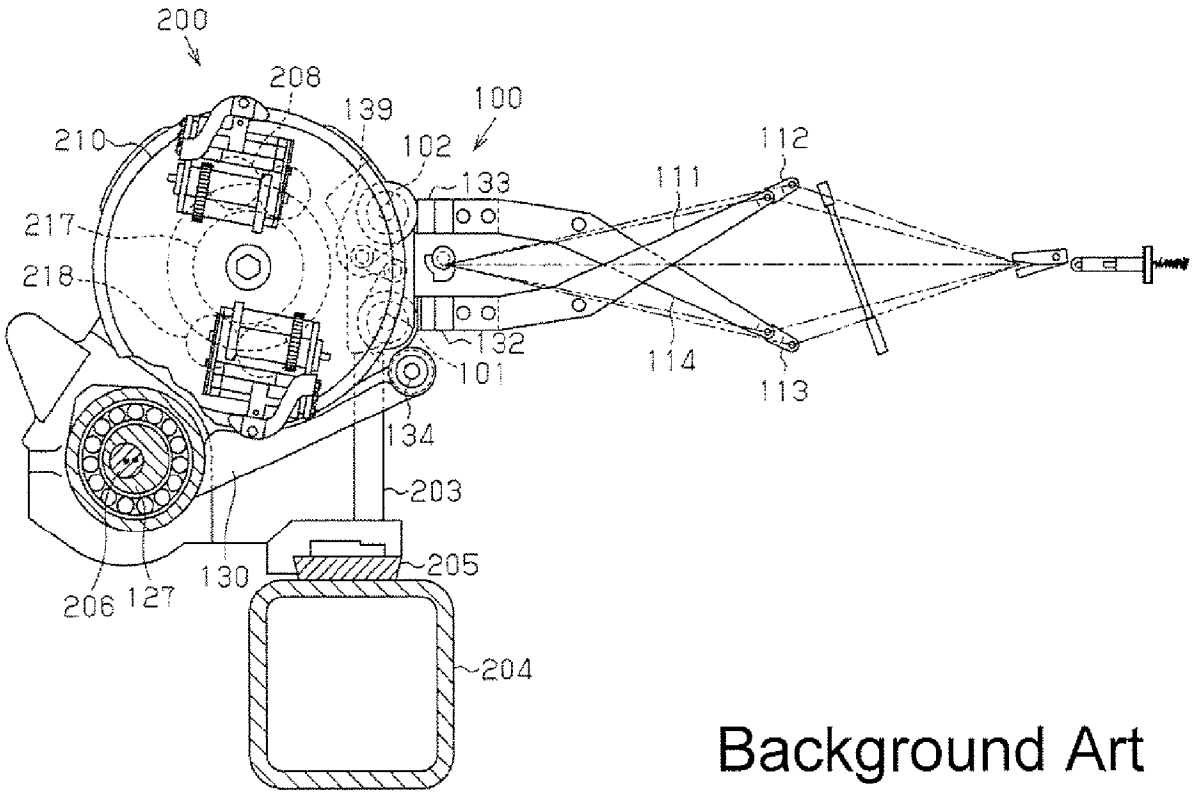
FIG. 9 is a side view of a shedding apparatus for catch cord as a background art.
Figure 10:
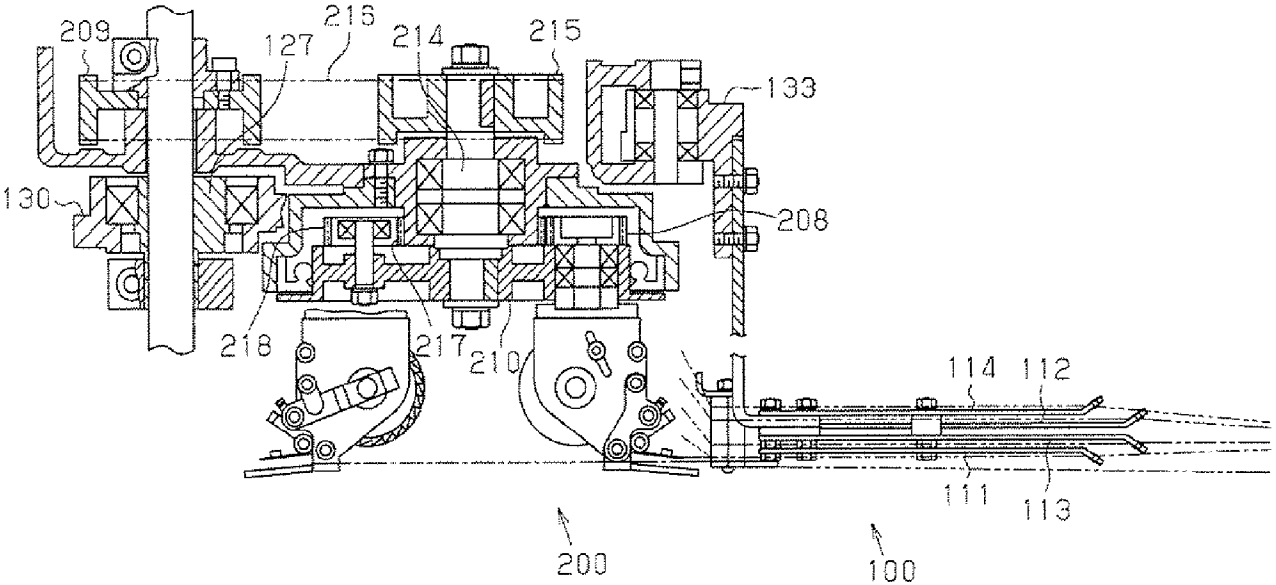
FIG. 10 is a partially cutaway plan view of the shedding apparatus for catch cord according to a background art.

Referring to FIGS. 3 and 8 showing the shedding apparatus 10, the eyelets 11A, 12A for waste selvage yarns and the like of the first swing levers 11, 13 and the second swing levers 12, 14 are positioned on warp line WL (shown in FIG. 8 only), wherein a shed of waste selvage yarns 50 is closed. This position of a closed shed occurs when a shed of warp yarns is closed. When the drive shaft 74A is driven by the electric motor M to rotate counterclockwise by 90 degrees from the position of FIG. 3, the crank 20 is also rotated counterclockwise by 90 degrees together with the drive shaft 74A. Accordingly, the connecting rod 21 causes the drive lever 22 to rotate counterclockwise about the support shaft 23 to the position of FIG. 5.

Figure 5:
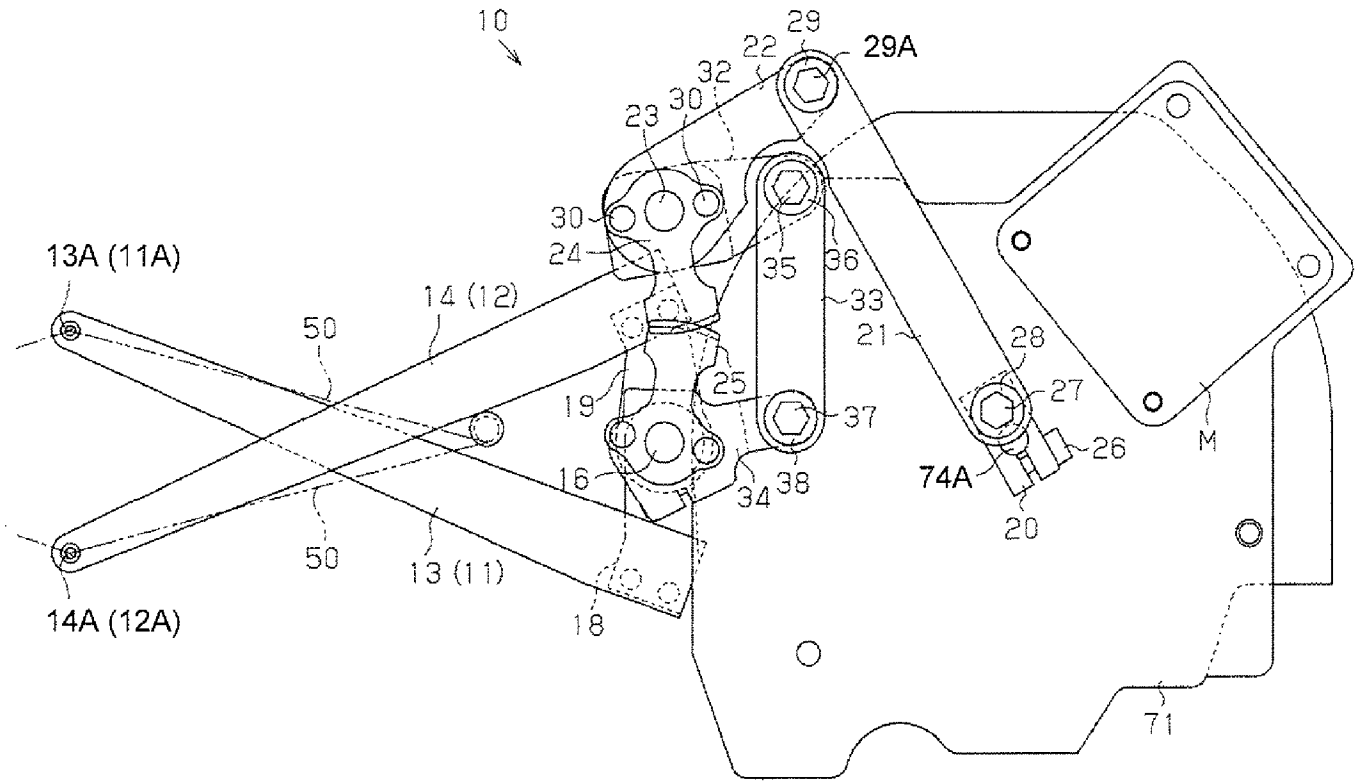
FIG. 5 is a side view of the shedding apparatus for waste selvage, showing a state wherein the drive shaft is rotated counterclockwise by 90 degrees from the position of FIG. 3.

While the drive lever 22 rotates from the position of FIG. 3 to the position of FIG. 5, the first sector gear 24 and the rotating lever 32 rotate together with the drive lever 22 counterclockwise about the support shaft 23 also from the position of FIG. 3. When the first sector gear 24 rotates counterclockwise about the support shaft 23 from the position of FIG. 3, the second sector gear 25 which is in engagement with the first sector gear 24 rotates together with the first rotating shaft 16 clockwise about the first rotating shaft 16 from the position of FIG. 3. The first swing levers 11, 13 fixedly supported on the first rotating shaft 16 via the support member 18 then rotate together with the first rotating shaft 16 clockwise about the first rotating shaft 16 from the position of FIG. 3, and the first swing levers 11, 13 are positioned with the tip ends thereof at a raised position, as shown in FIG. 5.

When the rotating lever 32 rotates counterclockwise about the support shaft 23 from the position of FIG. 3, the connecting lever 34 connected to the rotating lever 32 via the link 33 rotates together with the second rotating shaft 17 counterclockwise about the first rotating shaft 16 from the position of FIG. 3. The second swing levers 12, 14 fixedly supported on the second rotating shaft 17 via the support member 19 then rotate counterclockwise about the first rotating shaft 16 from the position in FIG. 3 and the ends of the second swing levers 12, 14 are positioned at a lowered position. As a result, the first swing levers 11, 13 and the second swing levers 12, 14 are positioned to form an open shed between the selvage yarns.

When the drive shaft 74A is rotated counterclockwise by 90 degrees from the position of FIG. 5, the crank 20 is also rotated counterclockwise by 90 degrees together with the drive shaft 74A. Accordingly, the connecting rod 21 causes the drive lever 22 to rotate clockwise about the support shaft 23 to the position of FIG. 6. While the drive lever 22 rotates from the position of FIG. 5 to the position of FIG. 6, the first sector gear 24 and the rotating lever 32 rotate clockwise together with the drive lever 22 about the support shaft 23 from the position of FIG. 5. While the first sector gear 24 rotates clockwise about the support shaft 23 from the position of FIG. 5, the second sector gear 25 which is in engagement with the first sector gear 24 rotates together with the first rotating shaft 16 counterclockwise about the first rotating shaft 16 from the position of FIG. 5. The first swing levers 11, 13 fixedly supported on the first rotating shaft 16 via the support member 18 then rotate together with the first rotating shaft 16 counterclockwise about the first rotating shaft 16 from the position of FIG. 5.

When the rotating lever 32 rotates clockwise about the support shaft 23 from the position in FIG. 5, the connecting lever 34 connected to the rotating lever 32 via the link 33 rotates together with the second rotating shaft 17 clockwise about the first rotating shaft 16 from the position of FIG. 5. The second swing levers 12, 14 integrally rotatably supported on the second rotating shaft 17 via the support member 19 then rotate clockwise about the first rotating shaft 16 from the position of FIG. 5. As a result, in the shedding apparatus 10 shown in FIG. 6, the eyelets 11A, 12A for waste selvage yarns and the like of the first swing levers 11, 13 and the second swing levers 12, 14 are positioned on the warp line WL that is the position where an open shed of the waste selvage yarns 50 is formed.

Subsequently, when the drive shaft 74A is rotated counterclockwise by 90 degrees from the position of FIG. 6, the crank 20 is also rotated counterclockwise by 90 degrees together with the drive shaft 74A. Accordingly, the connecting rod 21 causes the drive lever 22 to rotate clockwise about the support shaft 23 to the position of FIG. 7. While the drive lever 22 rotates from the position of FIG. 6 to the position of FIG. 7, the first sector gear 24 and the rotating lever 32 rotate together with the drive lever 22 clockwise about the support shaft 23 from the position of FIG. 6. When the first sector gear 24 rotates clockwise about the support shaft 23 from the position of FIG. 6, the second sector gear 25 which is in engagement with the first sector gear 24 rotates together with the first rotating shaft 16 counterclockwise about the first rotating shaft 16 from the position of FIG. 6. The first swing levers 11, 13 fixedly supported on the first rotating shaft 16 via the support member 18 then rotate is together with the first rotating shaft 16 counterclockwise about the first rotating shaft 16 from the position of FIG. 6.

Figure 6:
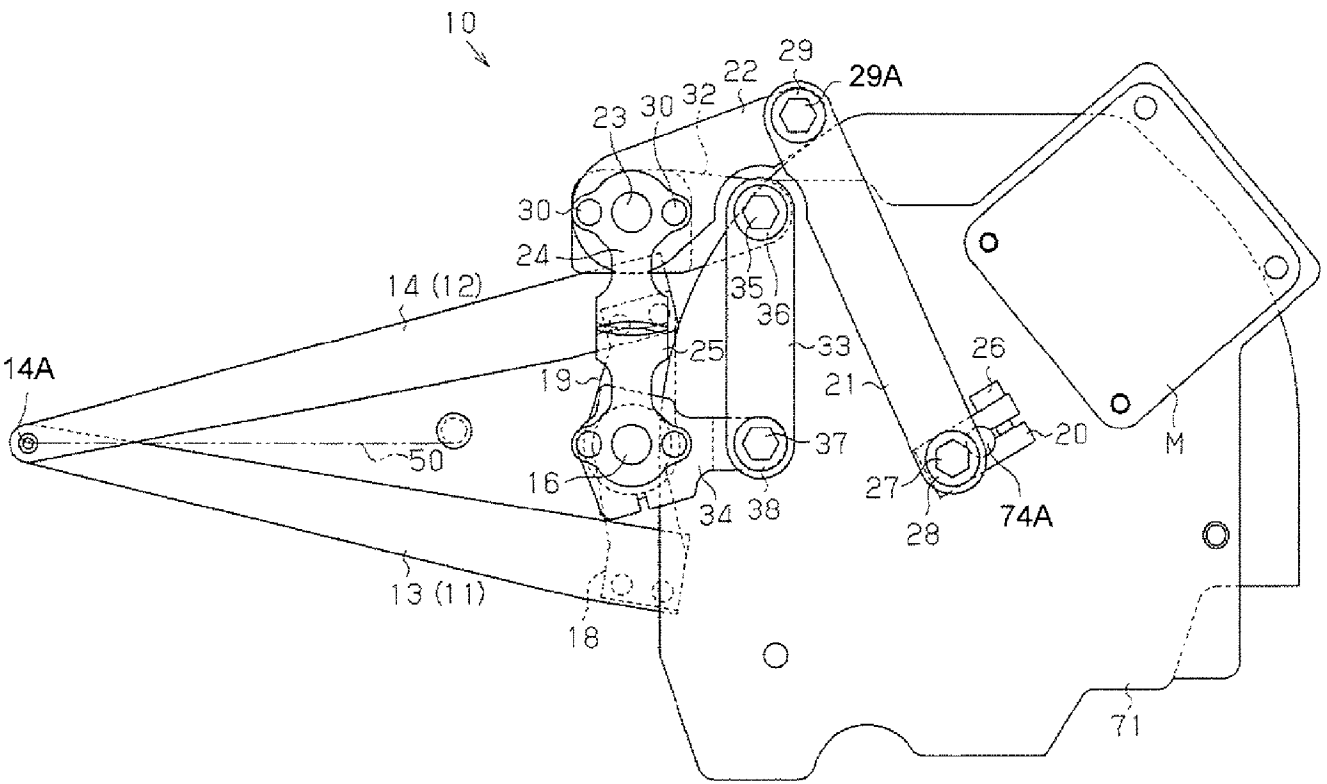
FIG. 6 is a side view of the shedding apparatus for waste selvage wherein the drive shaft is rotated counterclockwise by 90 degrees from the position of FIG. 5.

When the rotating lever 32 rotates clockwise about the support shaft 23 from the position of FIG. 6, the connecting lever 34 connected to the rotating lever 32 via the link 33 rotates together with the second rotating shaft 17 clockwise about the first rotating shaft 16 from the position of FIG. 6. The second swing levers 12, 14 fixedly supported on the second rotating shaft 17 via the support member 19 then rotate clockwise about the first rotating shaft 16 from the position of FIG. 6. As a result, in the shedding apparatus 10 shown in FIG. 7, the tip ends of the first swing levers 11, 13 are placed at the lowered position and the tip ends of the second swing levers 12, 14 are positioned at the raised position that is the position where an open state is formed by the waste selvage yarns.

When the drive shaft 74A is rotated counterclockwise by 90 degrees from the position of FIG. 7, the crank 20 is also rotated counterclockwise by 90 degrees together with the drive shaft 74A. Accordingly, the connecting rod 21 causes the drive lever 22 to rotate counterclockwise about the support shaft 23 to the position of FIG. 3. While the drive lever 22 rotates from the position of FIG. 7 to the position of FIG. 3, the first sector gear 24 and the rotating lever 32 rotate together with the drive lever 22 counterclockwise about the support shaft 23 from the position of FIG. 7. When the first sector gear 24 rotates counterclockwise about the support shaft 23 from the position of FIG. 7, the second sector gear 25 which is in engagement with the first sector gear 24 rotates together with the first rotating shaft 16 clockwise about the first rotating shaft 16 from the position of FIG. 7. The first swing levers 11, 13 fixedly supported on the first rotating shaft 16 via the support member 18 then rotate together with the first rotating shaft 16 clockwise about the first rotating shaft from the position of FIG. 7.

When the rotating lever 32 rotates counterclockwise about the support shaft 23 from the position of FIG. 7, the connecting lever 34 connected to the rotating lever 32 via the link 33 rotates together with the second rotating shaft 17 counterclockwise about the first rotating shaft 16 from the position of FIG. 7. The second swing levers 12, 14 integrally rotatably supported on the second rotating shaft 17 via the support member 19 then rotate counterclockwise about the first rotating shaft 16 from the position of FIG. 7. As a result, in the shedding apparatus 10, the eyelets 11A, 12A for waste selvage yarns and the like of the first swing levers 11, 13 and the second swing levers 12, 14 are positioned on the warp line WL, thus the first swing levers 11, 13 and the second swing levers 12, 14 returning to the position where the shed is closed as shown in FIG. 3. Thus, the shed opening and closing operations as described above are performed alternately and repeatedly with the rotation of the drive shaft 74A.

In the shedding apparatus 10, setting a proper ratio between the eccentric distance R of the crank 20 and the length L of the drive lever 22 (lever ratio, R/L) enables a significant reduction in the rotational torque of the shaft of the crank 20, i.e., the rotational torque of the drive shaft 74A due to a moment of inertia acting around the center axis of the drive lever 22. Specifically, the rotational torque of the drive shaft 74A corresponds to or is less than the square of the ratio between the eccentric distance R of the crank 20 and the length L of the drive lever 22 (lever ratio, R/L). Therefore, setting the lever ratio less than 1 reduces the rotational torque of the drive shaft 74A. For example, if the lever ratio (R/L) is 0.5, the rotational torque of the drive shaft 74A is one fourth or less than the rotational torque when the lever ratio is 1, and if the lever ratio is one third, the rotational torque of the drive shaft 74A is one ninth or less, which significantly reduces the force for driving the leno selvage forming apparatus 70. Therefore, an electric motor with a reduced capacity may be used as the electric motor M for driving the leno selvage forming apparatus 70. Though limited by the space available for arrangement, the desirable lever ratio ranges from one third to one sixth. In setting the lever ratio (R/L) in order to achieve maximum reduction of the rotational torque, the length of the connecting rod 21 should preferably be established such that the line segment X connecting the center of the drive shaft 74A and the center of the bolt 29A and the line segment Y connecting the center of the bolt 29A and the center of the support shaft 23 intersect with each other substantially at a right angle.

With the lever ratio (R/L) set at one sixth, the drive torque of the electric motor M was measured when the electric motor M was connected to the shedding apparatus 10 and when the electric motor M was not connected to the shedding apparatus 10. The torque calculated when the lever ratio was one sixth was calculated as $0.167^2=0.028$ or less, which matched the experimental value.

The moment of inertia of the shedding apparatus 10 acting around the shaft of the drive lever 22 when the moment of inertia of the electric leno selvage forming apparatus was 1 measured 1.05. Therefore, setting the lever ratio at 1 increases the entire drive torque twice or more, which requires an increased motor capacity.

When the leno selvage forming apparatus 70 is moved in accordance with the change of the weaving width of the loom, the drive shaft 74A as the drive source for the shedding apparatus 10 is also moved together. Therefore, unlike the conventional apparatus, the drive part of the shedding apparatus 10 does not need to be relocated for changing the weaving width of the loom and adjusting the timing is not necessary for either of the leno selvage forming apparatus 70 and the shedding apparatus 10. The timing for closing a shed in the shedding apparatus 10 can be adjusted by changing the timing of the leno selvage forming apparatus 70 and then changing the radial position of the crank 20.

The present embodiment according to the present invention offers the following advantageous effects.

(1) The shedding apparatus for waste selvage 10 of the embodiment is used in a loom having a leno selvage forming apparatus 70 of a planetary gear type, including the sun gear 73 and the planetary gears 77, 78 which revolve around the sun gear 73. The shedding apparatus for waste selvage 10 includes pairs of swing levers (the first swing levers 11, 13 and the second swing levers 12, 14) for forming an open shed by the waste selvage yarns 50, and it is so configured that the swing levers receive the drive force transmitted from the drive shaft 74A that is coaxial with the sun gear 73 through a crank mechanism. Therefore, when the leno selvage forming apparatus 70 is moved in accordance with a change of the weaving width of the loom, the drive shaft 74A as the drive source for the shedding apparatus 10 is moved with the leno selvage forming apparatus 70. In other words, the movement of the leno selvage forming apparatus 70 for the change of weaving width is simple and the leno selvage forming apparatus 70 can be moved without changing the operation timing of the shedding apparatus 10. Furthermore, the right-angle relation between the drive shaft 74A and the crank 20 is not affected by changing of the weaving width, causing no twisting damage to the crank mechanism of the leno selvage forming apparatus 70.

(2) The crank mechanism of the embodiment includes the connecting rod 21 and the drive lever 22. The connecting rod 21 is rotatably supported at the first end thereof eccentric from the drive shaft 74A. The drive lever 22 is rotatably connected at the first end thereof to the second end of the connecting rod 21 and integrally rotatably connected at the second end thereof to the rotating lever (the first sector gear 24 and the rotating lever 32) which transmits the rotational drive force to the swing levers. The ratio between the eccentric distance of the crank 20 and the length of the drive lever 22 is less than 1.

According to this configuration, the rotational torque of the crank shaft (the drive shaft 74A) due to the moment of inertia acting around the center axis of the drive lever 22 of the shedding apparatus 10 corresponds to or is less than the square of the ratio between the eccentric distance of the crank 20 and the length of the drive lever 22 (lever ratio). Therefore, the lever ratio of less than 1 reduces the rotational torque of the crank shaft (the drive shaft 74A).

(3) In the embodiment, the ratio between the eccentric distance of the crank 20 and the length of the drive lever 22 is one third or less. Then the rotational torque of the crank shaft corresponds to or is less than the square of the ratio between the eccentric distance of the crank 20 and the length of the drive lever 22. When the lever ratio is one third, the rotational torque of the crank shaft is one ninth or less of the rotational torque when the lever ratio is 1. Therefore, the lever ratio of one third or less enables a significant reduction in the force to drive the leno selvage forming apparatus 70.

(4) In the embodiment, the first rotating shaft 16 that drives the first swing levers 11, 13 and the second rotating shaft 17 that drives the second swing levers 12, 14 are concentrically provided. Therefore, the shedding apparatus 10 of the embodiment can be made smaller as compared with a shedding apparatus in which the first rotating shaft and the second rotating shaft are disposed parallel to each other.

(5) The leno selvage forming apparatus 70 of the embodiment is driven by the electric motor M provided independently from the motor for driving the loom. In the leno selvage forming apparatus 70 of the embodiment, therefore, the work associated with changing the weaving width of a loom is less troublesome as compared with the apparatus which is driven by the motor for the loom through any transmission apparatus.

(6) The crank 20 has in the first end thereof a slit and is fastened to the drive shaft 74A with the bolt 26 through the slit. Therefore, the adjustment of shed closing timing in the shedding apparatus 10 of the embodiment can be accomplished by changing the radial position of the crank 20 after the timing of the leno selvage forming apparatus 70 is changed.

The present invention is not limited to the above-described embodiment. The present invention may be practiced in various ways as exemplified below.

Instead of using the electric motor M provided independently from the motor for driving the loom, the leno selvage forming apparatus 70 may be driven by a motor for the loom through any suitable transmission apparatus.

Though the first rotating shaft 16 for driving the first swing levers 11, 13 and the second rotating shaft 17 for driving the second swing levers 12, 14 are provided centrically to each other in the embodiment, the first and second rotating shafts 16, 17 may be provided parallel to each other.

It is so configured in the embodiment that the rotation of the rotating support 74 is driven to be rotated by the drive gear 90 that is fixedly mounted on the output shaft 89 of the electric motor M and engaged with the driven gear 91 fixed on the drive shaft 74A for the rotating support 74. In order to drive the rotating support 74 by the electric motor M, however, a gear that is engaged with the drive gear 90 of the electric motor M. In this case, a center axis should be provided so as to pass through the bracket 71 from the center of the rotating support 74 to protrude to the side opposite to the leno selvage forming apparatus 70 for connection to the crank 20.

The first swing levers 11, 13 and the second swing levers 12, 14 need not necessarily be of the same length. For example, the configuration may be such that the first swing lever 11 and the second swing lever 14 have the same length and the first swing lever 13 and the second swing lever 12 have the same length and that the first swing lever 11 is longer than the first swing lever 13. It may be configured such that the tip end of the first swing lever 11 is bent away from the first swing lever 13 and the tip end of the second swing lever 12 is bent away from the second swing lever 14.

According to the embodiment of the present invention, the ratio of the eccentric distance R of the crank 20 to the length L of the drive lever 22, or the to lever ratio R/L, is less than 1 or one third or less. However, the lever ratio R/L may be 1 or more in the case of a motor with an increased capacity.

According to the embodiment of the present invention, the leno selvage forming apparatus 70 and the shedding apparatus 10 are mounted to the bracket 71. However, the shedding apparatus 10 may be mounted to a different bracket.

The leno selvage forming apparatus 70 and the shedding apparatus 10 may be mounted to the rail directly without using the bracket 71.

A support stand member may alternatively be used as the rail of the embodiment of the present invention, in order to support the leno selvage forming apparatus 70 and the shedding apparatus 10.

What is claimed is:

1. A shedding apparatus for waste selvage in a loom having a leno selvage forming apparatus of a planetary gear type including a sun gear and a pair of planetary gears which revolves around the sun gear, wherein the waste selvage is formed at positions outward of leno selvages and the waste selvage is to be removed from a woven fabric, the shedding apparatus for waste selvage comprising: a pair of swing levers for forming an open shed of selvage yarns, wherein drive force to the swing levers is transmitted by a crank mechanism through center axis of a rotating support supporting the planetary gears.

2. The shedding apparatus for waste selvage according to claim 1, wherein the crank mechanism includes:

a crank, first end of which is fixedly connected to the center axis for rotation therewith;

a drive lever for transmitting a rotational force to the swing levers; and a connecting rod connected between second end of the crank and the drive lever, and a ratio between an eccentric distance of the crank and a length of the drive lever is less than 1.

3. The shedding apparatus for waste selvage according to claim 2, wherein the ratio between the eccentric distance of the crank and the length of the drive lever is one third or less.

4. The shedding apparatus for waste selvage according claim 1, wherein the leno selvage forming apparatus is mounted to a bracket which is adjustable along a rail extending between opposite side frames of the loom, and the shedding apparatus for waste selvage is also mounted to the bracket.

* * * * *